US011425955B2

(12) United States Patent
Kim et al.

(10) Patent No.: US 11,425,955 B2
(45) Date of Patent: Aug. 30, 2022

(54) METHOD FOR MANUFACTURING A KOREAN TRADITIONAL WOMEN'S HEADPIECE

(71) Applicants: Miehee Ju Kim, Daejeon (KR); Jean Kim, Daejeon (KR)

(72) Inventors: Miehee Ju Kim, Daejeon (KR); Jean Kim, Daejeon (KR)

( * ) Notice: Subject to any disclaimer, the term of this patent is extended or adjusted under 35 U.S.C. 154(b) by 68 days.

(21) Appl. No.: 17/160,818

(22) Filed: Jan. 28, 2021

(65) Prior Publication Data

US 2022/0232926 A1 Jul. 28, 2022

(51) Int. Cl.
*A42C 1/00* (2006.01)

(52) U.S. Cl.
CPC ..... *A42C 1/00* (2013.01)

(58) Field of Classification Search
CPC ..... A42C 1/00
See application file for complete search history.

*Primary Examiner* — F Griffin Hall
(74) *Attorney, Agent, or Firm* — Novick, Kim & Lee, PLLC; Jae Youn Kim

(57) ABSTRACT

Disclosed is a method for manufacturing a jokduri in which a primary cotton member is inserted into an outer frame formed of fabric, an inner frame is mounted in the outer frame, and then a secondary cotton member is inserted into a space between the inner frame and the outer frame so that not only the upper region of the inside of the outer frame but also the left and right sides of the inside of the outer frame are uniformly filled with cotton and thus the overall shape of the jokduri may be easily fixed, thereby shortening the time taken to fix the shape of the jokduri and enabling the jokduri to be easily manufactured regardless of a worker's proficiency, unlike a jokduri manufactured by the conventional method.

4 Claims, 14 Drawing Sheets

METHOD FOR MANUFACTURING A KOREAN TRADITIONAL WOMEN'S HEADPIECE

BACKGROUND OF THE INVENTION

Field of the Invention

The present invention relates to a method for manufacturing a Korean traditional women's headpiece (Hereafter, it is called "jokduri"), and more particularly to a method for manufacturing a jokduri in which a primary cotton member is inserted into an outer frame formed of fabric, an inner frame is mounted in the outer frame, and then a secondary cotton member is inserted into a space between the inner frame and the outer frame so that not only the upper region of the inside of the outer frame but also the left and right sides of the inside of the outer frame are uniformly filled with cotton and thus the overall shape of the jokduri may be easily fixed, so as to shorten the time taken to fix the shape of the jokduri and to enable the jokduri to be easily manufactured regardless of a worker's proficiency, unlike a jokduri manufactured by the conventional method.

Description of the Related Art

In general, a jokduri, which is also called "jok-a", "jokdu" or "jokgwan" in Korean, is a type of Korean transitional coronet worn in the Joseon Dynasty by women dressed formally for special occasions such as weddings. The jokduri is covered with black silk, the upper part thereof is vaguely hexagonal, and the bottom part thereof is cylindrical. The jokduri resembles a small unbrimmed hat, and is fixed using a Korean traditional ornamental hairpin called "binyeo" in Korean. The jokduri is filled with cotton, is colored red, and is covered with black silk. The jokduri may be used without ornamentation, or may be decorated with jewelry.

Different kinds of jokduri have been used, i.e., jokduri for weddings which are ornately decorated with jewelry, jokduri for funeral rites and ancestral rites which are unadorned, and jokduri for daily use which are used at royal court and in noble families, according to the purpose thereof.

Further, jokduri are classified into cotton jokduri, single-layered jokduri, and Eoyeom jokduri according to the shape of the frame that is used, and are classified into single-crested jokduri and double-crested jokduri according to the decoration manner thereof.

Jokduri have been widely used for various ceremonies, such as weddings, funeral rites and ancestral rites, regardless of one's social position, and today remains in existence by being used in traditional weddings.

In addition, jokduri have been used only by married women and have been mainly used in ceremonies such as weddings, and today are used by brides of newly-wedded couples in a traditional ceremony right after their wedding for greeting the bridegroom's family, called "pyebaek" in Korean.

In general, it is said that the jokduri evolved from a Mongolian woman's cap for outings, the gogo (or the gogogwan or the gogori).

At the beginning, the jokduri was used only in the royal court, but in the late Joseon period, King Yeongjo and Jeongjo prohibited women from wearing wigs called "gache" in Korean because the costs and the negative effects thereof were increased and, instead, encouraged them to wear the jokduri, and thus, women in all classes from the aristocracy to common people enjoyed wearing jokduri.

When a jokduri is manufactured using a traditional method, an outer frame is made by cutting an outshell fabric and is filled with cotton so as to from the external appearance of the jokduri, and in this case, it may be difficult to fix the shape of the jokduri due to imbalance of the outer frame and it may take an excessively long time to manufacture the jokduri.

SUMMARY OF THE INVENTION

Therefore, the present invention has been made in view of the above problems, and it is an object of the present invention to provide a method for manufacturing a jokduri in which a primary cotton member is inserted into an outer frame formed of fabric, an inner frame is mounted in the outer frame, and then a secondary cotton member is inserted into a space between the inner frame and the outer frame so that not only the upper region of the inside of the outer frame but also the left and right sides of the inside of the outer frame are uniformly filled with cotton and thus the overall shape of the jokduri may be easily fixed, so as to shorten the time taken to fix the shape of the jokduri and to enable the jokduri to be easily manufactured regardless of a worker's proficiency, unlike a jokduri manufactured by the conventional method.

It is another object of the present invention to provide a method for manufacturing a jokduri in which the jokduri is not only manufactured to be worn together with Korean traditional clothes called "hanbok" in Korean, but also manufactured in a small size to be made into a key ring, an ornament or an accessory, so as to be used as a medium which may widely introduce and promote Korean traditional cultural heritage.

In accordance with the present invention, the above and other objects can be accomplished by the provision of a method for manufacturing a jokduri, including preparing an outer frame having a cylindrical shape having an open lower part by connecting a plurality of outer frame pieces by sewing, filling an upper region of an inside of the outer frame with a primary cotton member, preparing an inner frame having a cylindrical shape having an open lower part, inserting the inner frame into the outer frame so as to be disposed directly under the primary cotton member and then fixing the inner frame to the outer frame, filling a side space formed between the outer frame and the inner frame with a secondary cotton member, and preparing a jokduri frame by finishing the outer frame by sewing a lower end of the outer frame in a state in which the lower end of the outer frame is pulled inwards.

The inner frame may be formed of paper, and may include an upper inner frame having a circular shape, and a side inner frame having a cylindrical shape configured to be vertically open and coupled to the upper inner frame, a plurality of first through holes may be formed through an edge of the upper inner frame so as to be disposed in a circumferential direction thereof, a plurality of second through holes may be formed through an upper portion of the side inner frame so as to be disposed in a circumferential direction thereof, and the upper inner frame and the side inner frame may be connected by inserting thread into the first through holes and the second through holes.

The inner frame may be formed of a synthetic resin, and may include an upper inner frame having a circular shape, and a side inner frame having a cylindrical shape configured to extend integrally from the upper inner frame.

The method may further include preparing a lower lid including an insert part configured to surround an inner surface of the inner frame and an edge part configured to extend in a radial direction of the insert part, and connecting the lower lid to the jokduri frame.

The lower lid may be prepared by preparing the insert part and the edge part by cutting a lining fabric and then connecting the the insert part and the edge part, and the edge part of the lower lid and the jokduri frame may be finished by sewing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, reference will now be made in detail to various embodiments of the present invention, examples of which are illustrated in the accompanying drawings and described below.

In the following description of the present invention, a detailed description of known functions and configurations incorporated herein will be omitted when it may make the subject matter of the present invention rather unclear. Also, the terms used in the following description are terms defined taking into consideration the functions obtained in accordance with the present invention, and definitions of these terms may be changed in accordance with the intention of a user or operator or a usual practice. Therefore, the definitions of the terms should be determined based on the overall content of this specification.

Figure 1:
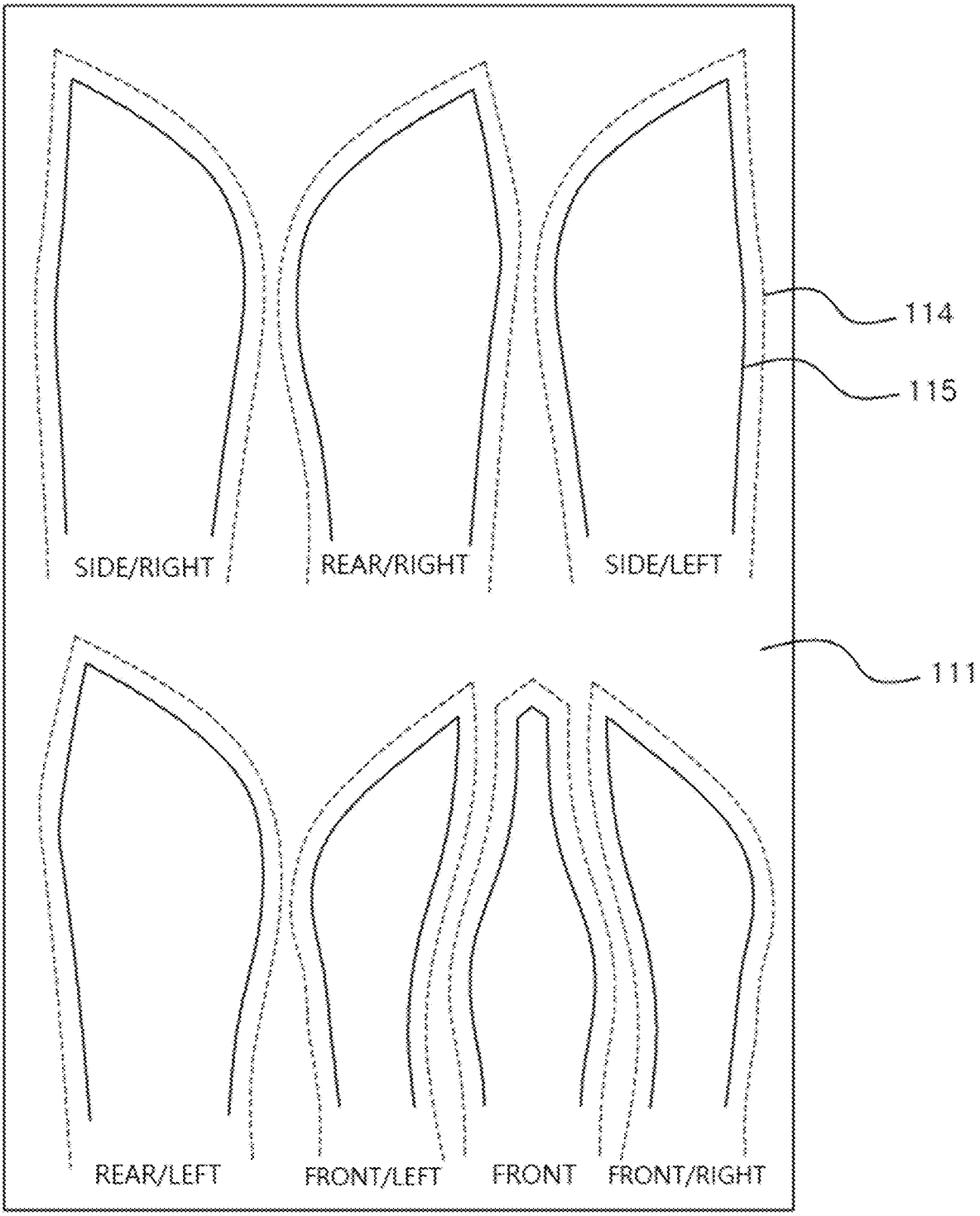
FIG. 1 is a view illustrating cutting lines for cutting outer frame pieces and sewing lines for sewing the outer frame pieces, drawn on an outshell fabric used in a method for manufacturing a jokduri according to the present invention.
Figure 2:
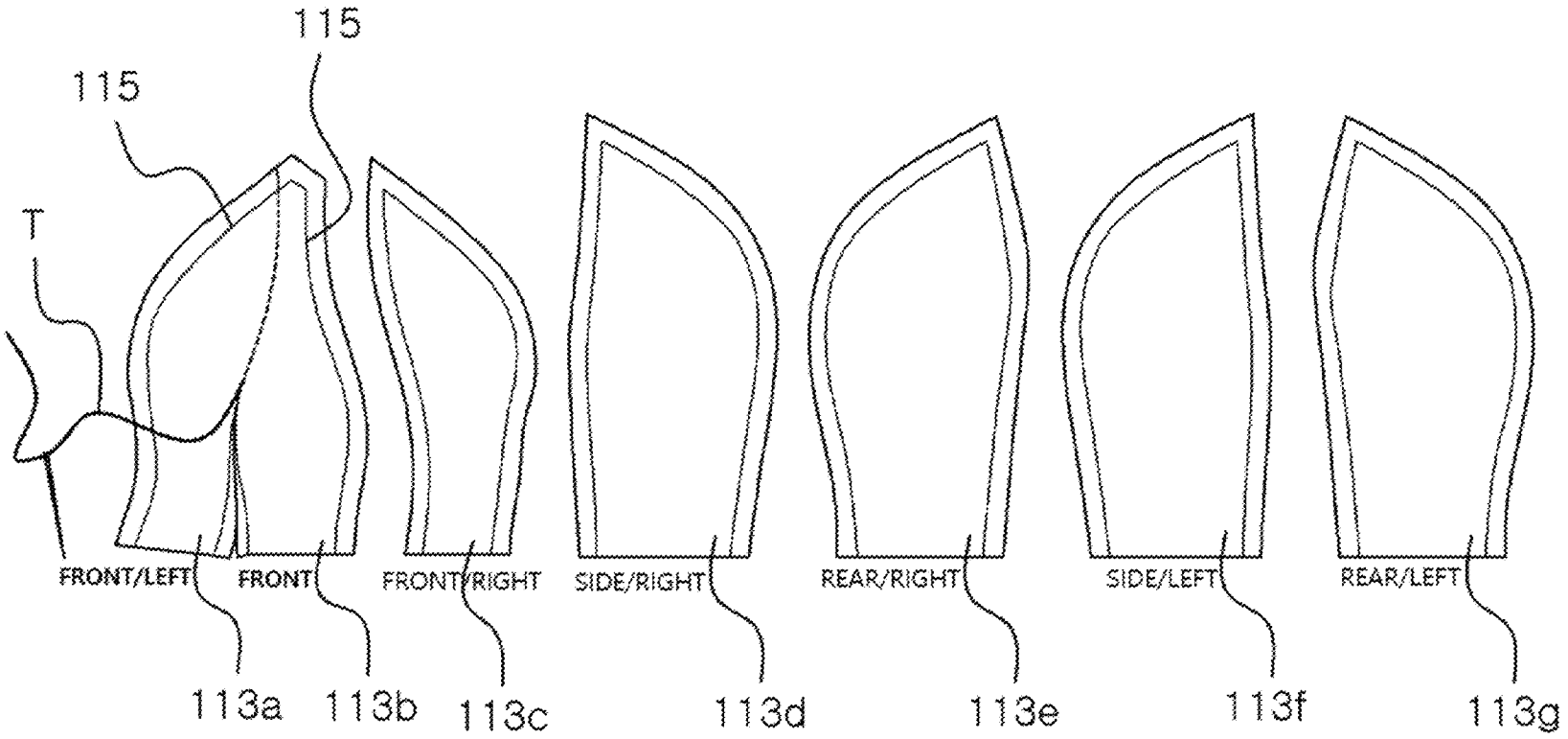
FIG. 2 is a view illustrating connection of the outer frame pieces according to the present invention by sewing.
Figure 3:
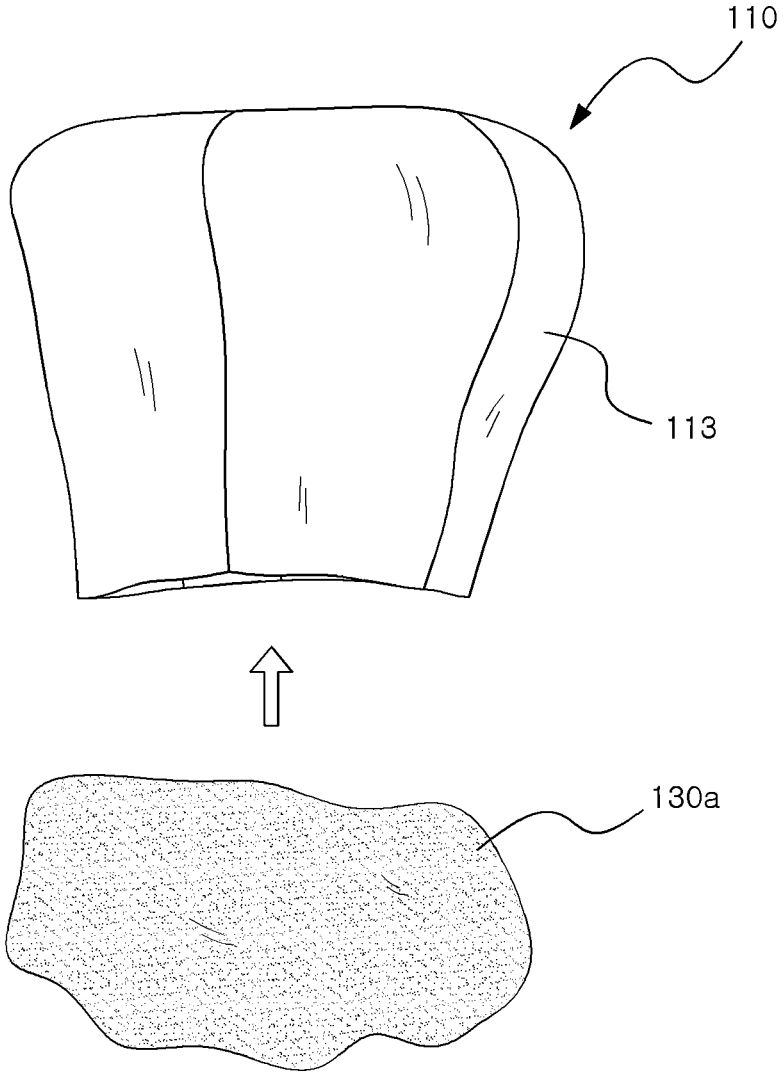
FIG. 3 is a perspective view illustrating the state in which an outer frame prepared by connecting the outer frame pieces according to the present invention is filled with a primary cotton member.

FIG. 1 is a view illustrating cutting lines for cutting outer frame pieces and sewing lines for sewing the outer frame pieces, drawn on an outshell fabric used in a method for manufacturing a jokduri according to the present invention, FIG. 2 is a view illustrating connection of the outer frame pieces according to the present invention by sewing, and FIG. 3 is a perspective view illustrating the state in which an outer frame prepared by connecting the outer frame pieces according to the present invention is filled with a primary cotton member.

Figure 4:
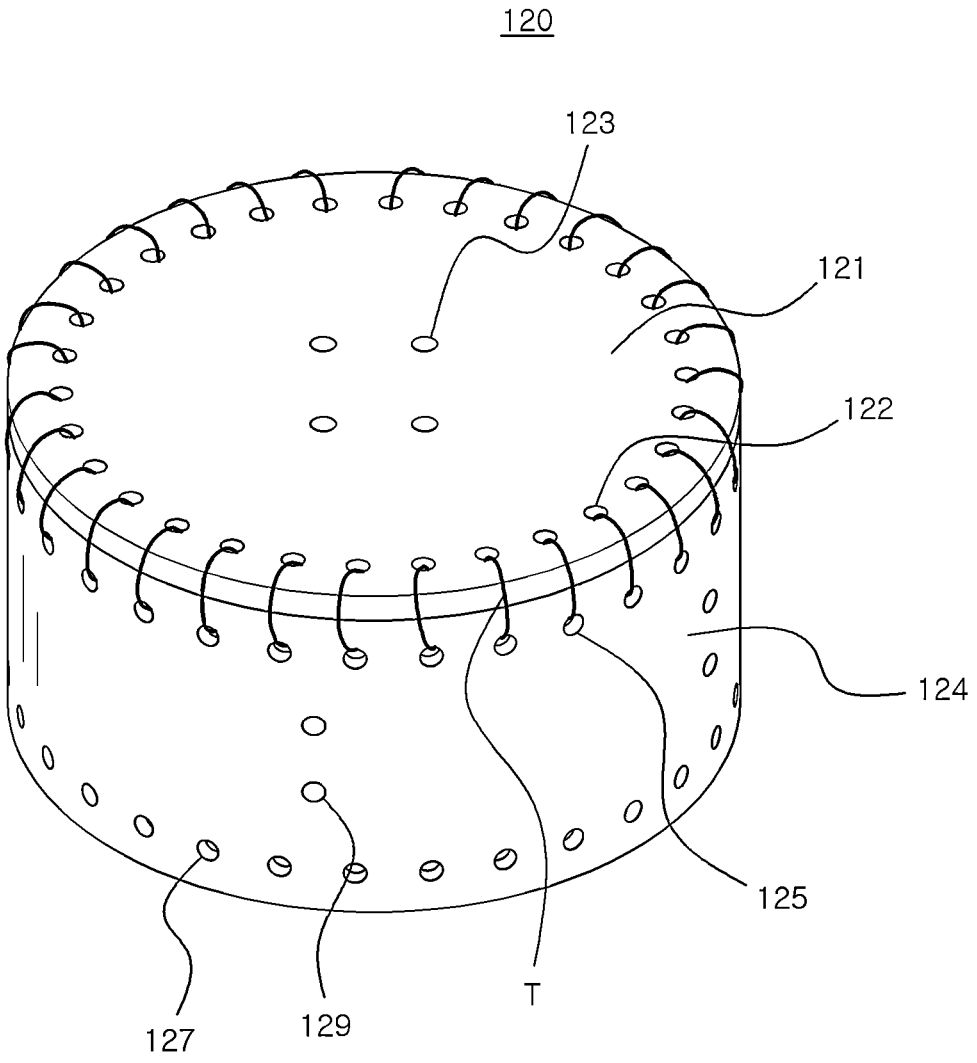
FIG. 4 is a perspective view illustrating the structure of an inner frame according to the present invention.
Figure 5:
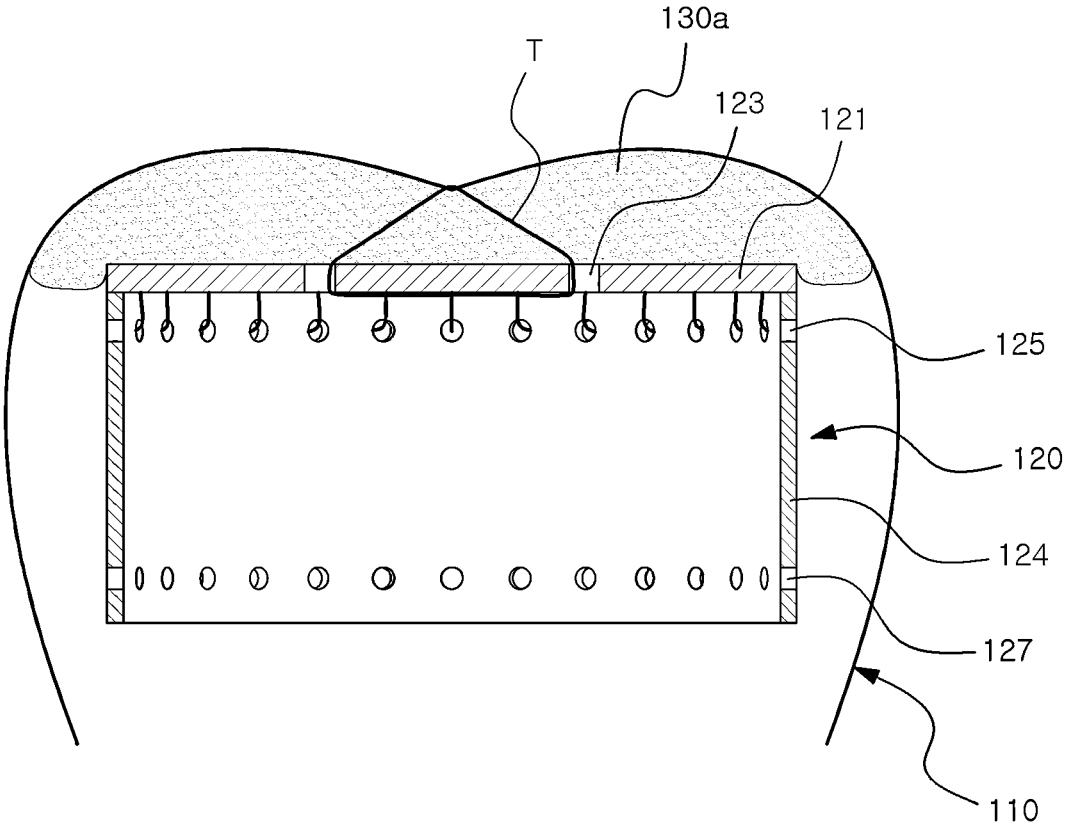
FIG. 5 is a cross-sectional view illustrating the state in which the primary cotton member and the inner frame are fixed to the outer frame according to the present invention.
Figure 6A:
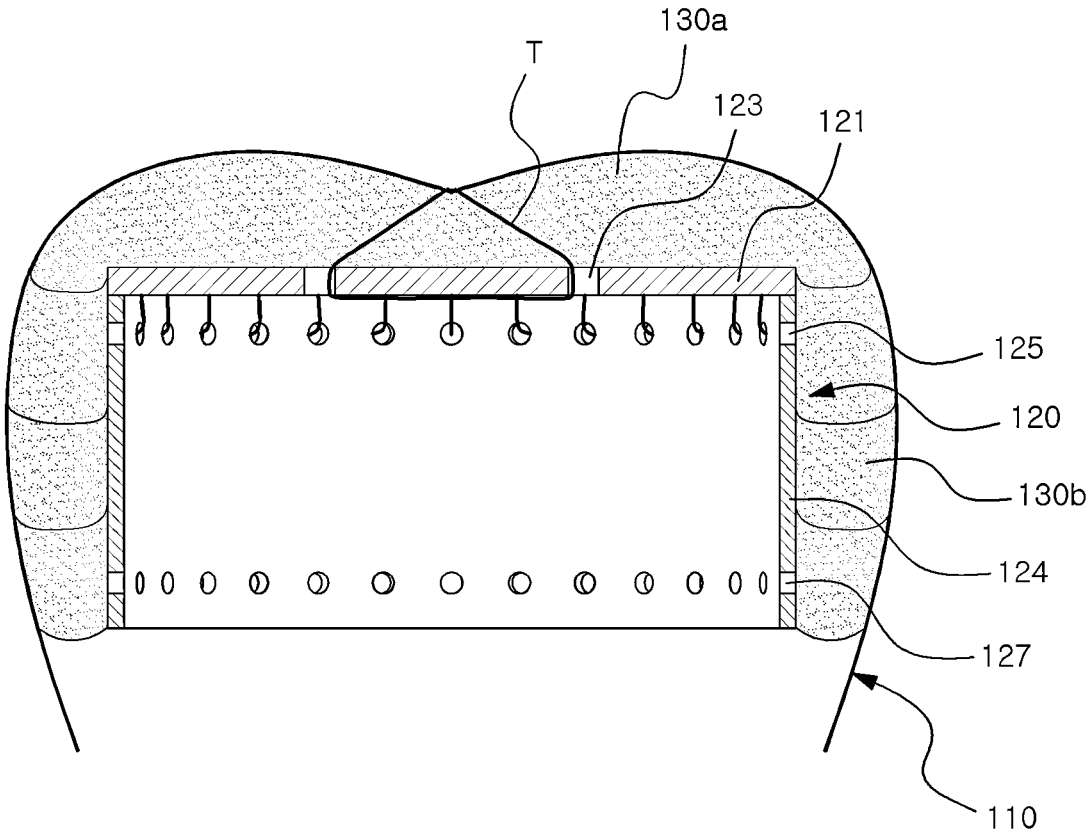
FIG. 6A is a cross-sectional view illustrating the state in which the outer frame in the state of FIG. 5 is filed with a secondary cotton member.
Figure 6B:
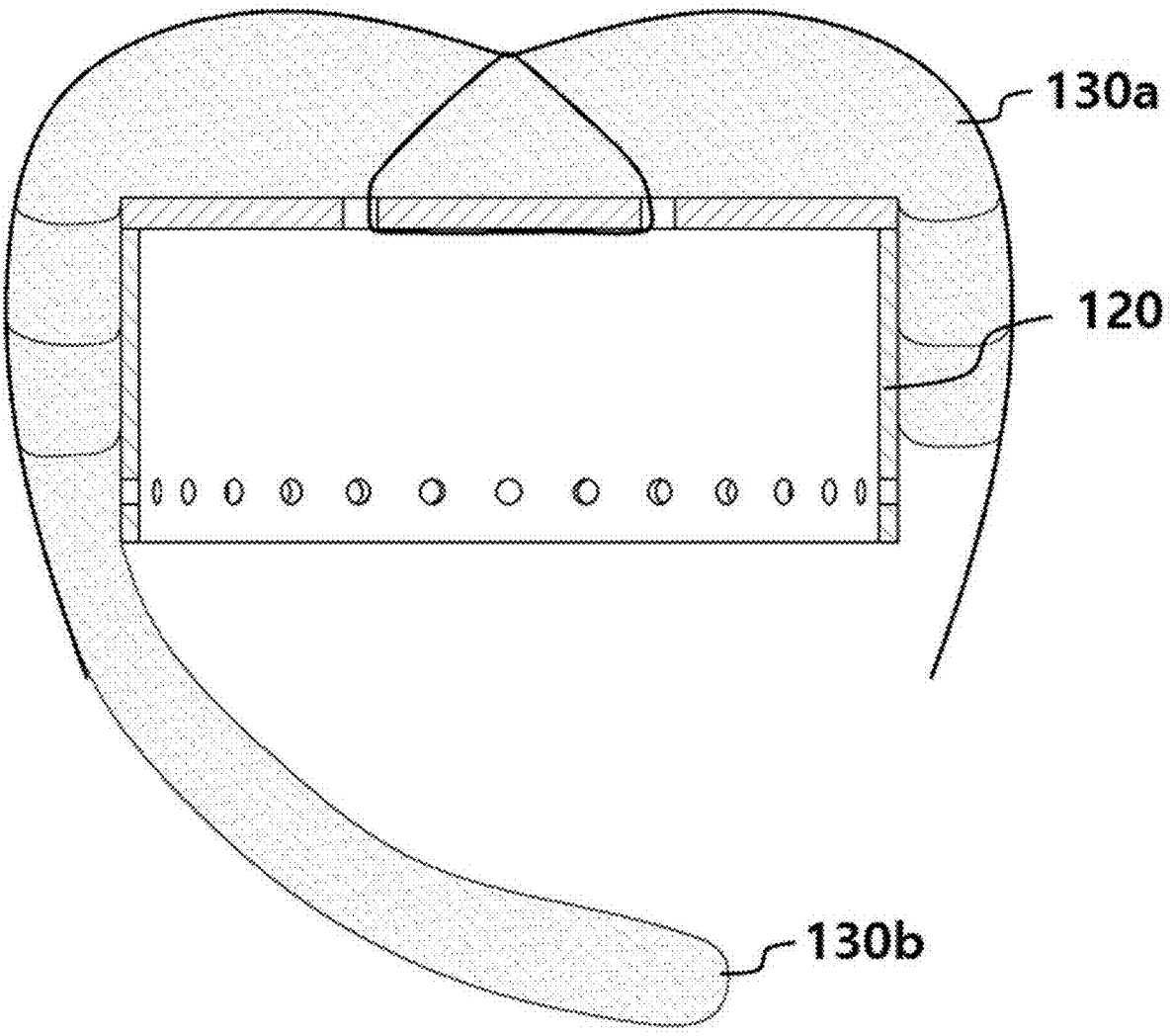
FIG. 6B is a cross-sectional view illustrating the state in which the outer frame in the state of FIG. 6A is filed with the secondary cotton member.

FIG. 4 is a perspective view illustrating the structure of an inner frame according to the present invention, FIG. 5 is a cross-sectional view illustrating the state in which the primary cotton member and the inner frame are fixed to the outer frame according to the present invention, FIG. 6A is a cross-sectional view illustrating the state in which the outer frame in the state of FIG. 5 is filed with a secondary cotton member, and FIG. 6B is a cross-sectional view illustrating the state in which the outer frame in the state of FIG. 6A is filed with the secondary cotton member.

Referring to FIGS. 1 to 6A, a method for manufacturing a jokduri according to the present invention includes preparing an outer frame 110 having a cylindrical shape having an open lower part by connecting a plurality of outer frame pieces 113 by sewing, filling the upper region of the inside of the outer frame 110 with a primary cotton member 130*a*, preparing an inner frame 120 having a cylindrical shape having an open lower part, inserting the inner frame 120 into the outer frame 110 so as to be disposed directly under the primary cotton member 130*a* and then fixing the inner frame 120 to the outer frame 110, filling a side space formed between the outer frame 110 and the inner frame 120 with a secondary cotton member 130*b*, and preparing a jokduri frame 100*a* by finishing the outer frame 110 by sewing the lower end of the outer frame 110 in the state in which the lower end of the outer frame 110 is pulled inwards.

In the preparation of the outer frame 110, first, the outer frame pieces 113 are prepared. As shown in FIG. 1, cutting lines 114 for a total of seven outer frame pieces 113 and sewing lines 115 located inside the respective cutting lines 114 are drawn on an outshell fabric 111, and then the outer frame pieces 113 are cut out along the cutting lines 114.

Here, if the sewing lines 115 drawn inside the cutting lines 114 are directly printed on the outshell fabric 111, mass-production is facilitated.

Thereafter, the seven outer frame pieces 113, i.e., outer frame pieces 113*a*, 113*b*, 113*c*, 113*d*, 113*e*, 113*f* and 113*g*, are disposed in the order shown in FIG. 2, and the outer frame 111 having the cylindrical shape, the lower part of which is open, is prepared by sewing the neighboring outer frame pieces 113 along the sewing lines 115.

The inner frame 120 may be prepared using thick paper, such as a cardboard, or by A overlapping several layers of paper and, as shown FIG. 4, may include an upper inner frame 121 having a circular shape, and a side inner frame 124 having a cylindrical shape configured to be vertically open so as to be coupled to the upper inner frame 121.

Further, as shown in FIG. 4, a plurality of first through holes 122 is formed through the edge of the upper inner frame 121 so as to be disposed in the circumferential direction thereof, a plurality of second through holes 125 is formed through the upper portion of the side inner frame 124, that comes into contact with the upper inner frame 121, so as to be disposed in the circumferential direction of the side inner frame 124, a plurality of third through holes 127 is formed through the lower portion of the side inner frame 124 so as to be disposed in the circumferential direction thereof, upper and lower side holes 129, which are paired, are formed through the central portion of the side inner frame 124 so as to be disposed in the circumferential direction thereof, and the side holes 129 are configured such that wires 152*b* connected to threads 152*a* of ornaments 152 are inserted into the side holes 129 so as to be fixed. In the conventional jokduri, an ornament is fixed to the side surface of the jokduri using only thread and thus the thread frequently breaks, whereby the ornament is no longer supported, as has been reported in jokduri relics stored for a long period of time, and therefore, the method according to the present invention solves this problem through a combination of the wires 152*b* and the side holes 129.

Four central through holes 123, which are used when the inner frame 120 is fixed to the outer frame 110 by thread or when a jewelry ornament 150 (in FIG. 8) is fixed to the center of the upper portion of the outer frame 110 using a wire or thread, are formed through the center of the upper inner frame 121.

Preparation of the inner frame 120 is completed by firmly connecting the upper inner frame 121 and the side inner frame 124 in a manner in which thread T is inserted into the first through holes 122 and the second through holes 125.

Thereafter, as shown in FIG. 3, the inside of the outer frame 110 is filled with the primary cotton member 130*a*, and then, as shown in FIG. 5, the inner frame 120 is fixed to the outer frame 110.

Here, the upper portion of the inner space of the outer frame 110 is filled with the primary cotton member 130*a* to a designated thickness so as to be levelled, and then, the inner frame 120 is fixed to the outer frame 110 under the primary cotton member 130*a*.

The inner frame 120 is inserted into the outer frame 110, and is then fixed to the outer frame 110 by sewing. Here, sewing is performed by inserting the thread T into the central through holes 123 of the inner frame 120 and the center of the upper portion of the outer frame 110.

Thereafter, as shown in FIGS. 6A and 6B, the de space between the outer frame 110 and the inner frame 120 is filled with the secondary cotton member 130*b*, and in this case, the second cotton member 130 fills the side space while being compressed using hands or a stick so as to prevent creation of empty spaces and thus the overall shape of the jokduri is formed.

In the conventional jokduri, the inside of the outer frame is merely filled with cotton without using an inner frame and thus the inside of the outer frame may be locally unevenly filled with cotton and there may be difficulty in uniformly forming the overall external shape of the jokduri, and if the external shape of the jokduri is not properly fixed, cotton must be removed and then the inside of the outer frame must be refilled with cotton.

In contrast, in the jokduri according to the present invention, the inner frame 120 is mounted in the outer frame 110 and the inside of the outer frame 110 is separately filled with the primary cotton member 130*a* and the secondary cotton member 130*b*, and thus a process of fixing the shape of the jokduri may be easily performed. Particularly, the process of compressing and fixing a small amount of the primary cotton member 130*a* compared with the case of the conventional jokduri when the inner frame 120 is installed and the process of filling the space between the outer frame 110 and the inner frame 120 with the secondary cotton member 130*b* while compressing the secondary cotton member 130*b* are separated from each other, and thus, the external shape of the jokduri may be properly formed regardless of a worker's proficiency.

Here, as shown in FIG. 6A, the secondary cotton member 130*b* extending a long length is wound on the outer surface of the inner frame 120, and thus, the side space formed between the outer frame 110 and the inner frame 120 may be uniformly filled with the secondary cotton member 130*b* and workability may simultaneously be greatly improved.

Figure 7A:
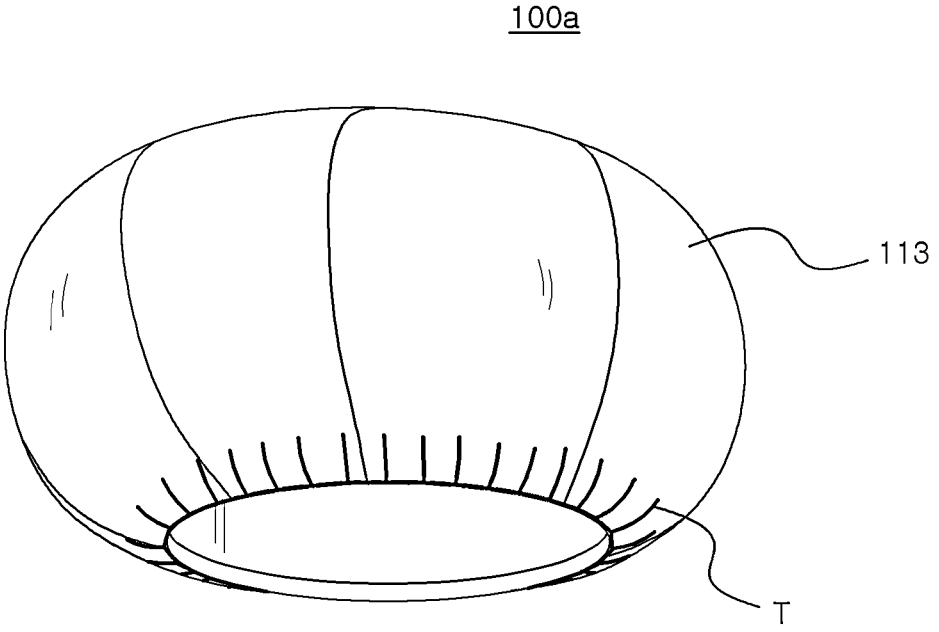
FIG. 7A is a bottom perspective view illustrating the overall external shape of a jokduri frame according to the present invention.
Figure 7B:
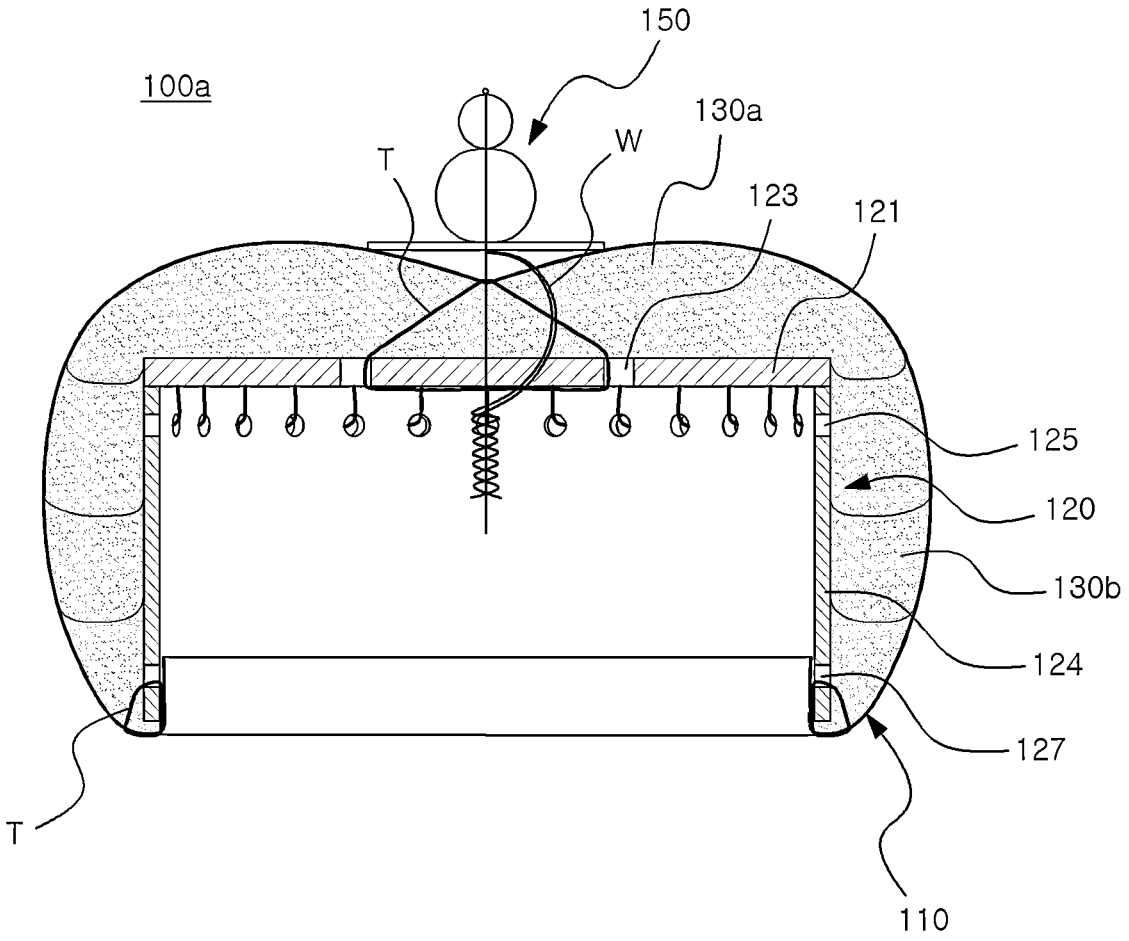
FIG. 7B is a cross-sectional view illustrating the state in which a jewelry ornament is fixed to the jokduri frame of FIG. 7A.
Figure 7C:
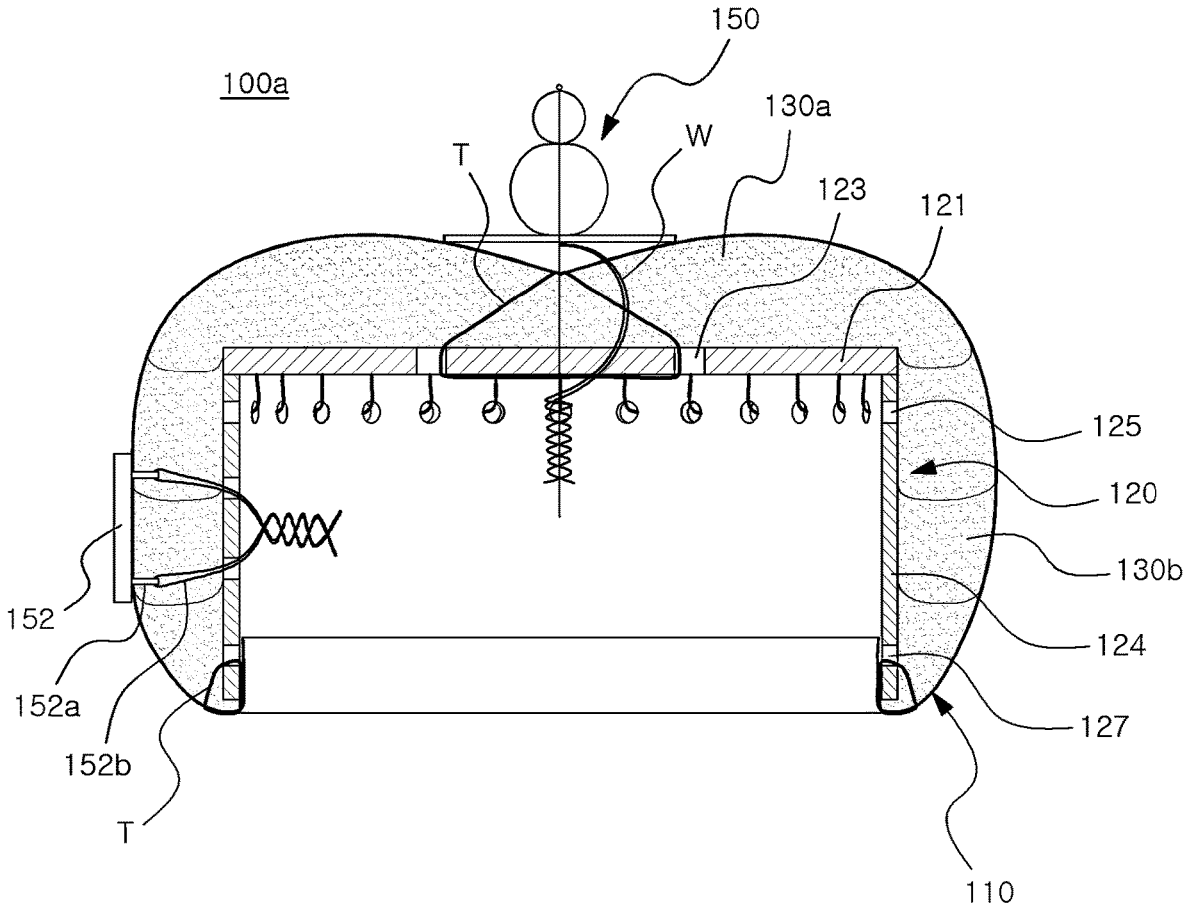
FIG. 7C is a cross-sectional view illustrating the state in which other ornaments are additionally fixed to the jokduri frame according to the present invention.
Figure 7D:
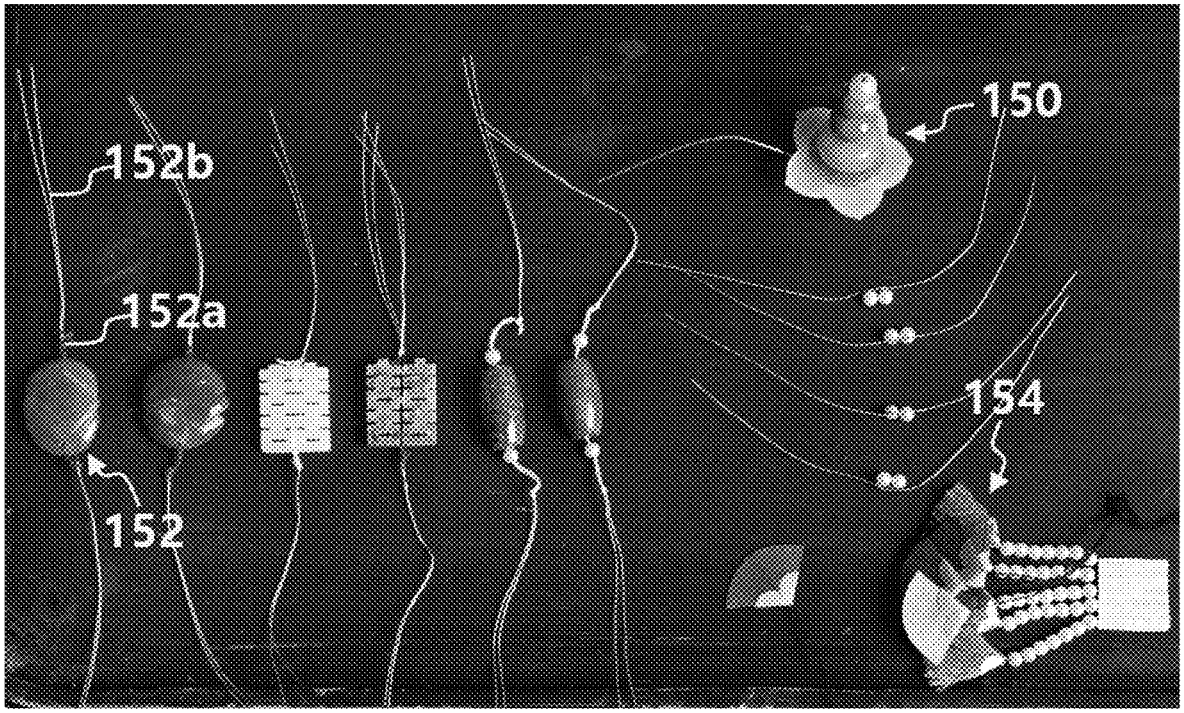
FIG. 7D is a photograph showing the jewelry ornament and the ornaments of FIG. 7C.

FIG. 7A is a bottom perspective view illustrating the overall external shape of the jokduri frame according to the present invention, FIG. 7B is a cross-sectional view illustrating the state in which a jewelry ornament is fixed to the jokduri frame of FIG. 7A, FIG. 7C is a cross-sectional view illustrating the state in which other ornaments are additionally fixed to the jokduri frame according to the present invention, and FIG. 7D is a photograph showing the jewelry ornament and the ornaments of FIG. 7C.

As shown in FIGS. 7A to 7D, the jokduri frame 100*a* is prepared by finishing the outer frame 110 by sewing the lower end of the outer frame 110 in the state in which the lower end of the outer frame 110 is pulled inwards. Here, the lower end of the outer frame 110 is firmly closed so that the secondary cotton member 130*b* does not leak out from the outer frame 110 by passing thread T through the outer frame 110 and the third through holes 127 of the inner frame 120.

Figure 8:
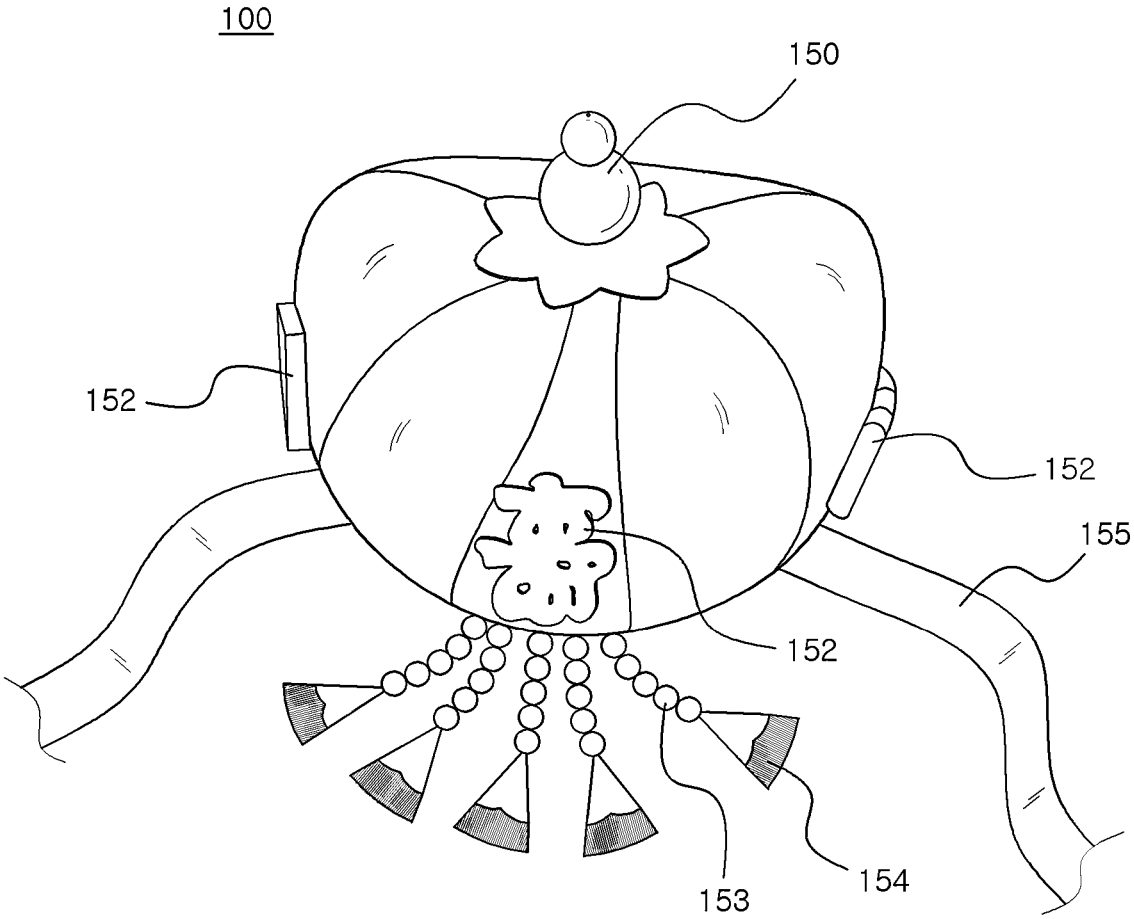
FIG. 8 is a perspective view illustrating the state in which various ornaments including the jewelry ornament are adhered to the jokduri according to the present invention.

Thereafter, as shown in FIG. 8, the jewelry ornament 150 formed of jade, coral, pearl and the like is fixedly mounted at the center of the upper portion of the jokduri frame 100*a*, and in this case, in a manner similar to the above-described manner of fixing the inner frame 120 to the outer frame 110, the jewelry ornament 150 is coupled to a wire 151 and then the wire 151 having the jewelry ornament 150 coupled thereto is inserted into the central through holes 123 of the inner frame 120. Further, other ornaments 152 are coupled to four side surfaces of the jokduri frame 100*a*, i.e., front, rear, left and right surfaces thereof, and the kinds or shapes of the ornaments 152 may vary.

Further, when a separate wire W is inserted into the inner frame 120 and then one side of the wire 151 having the jewelry ornament 150 coupled thereto is connected to the separate wire W, the jewelry ornament 150 may be fixed more firmly.

A lower lid 140 including an insert part 141 configured to surround the inner surface of the inner frame 120 and an edge part 142 configured to extend in the radial direction of the insert part 141 is prepared, and the lower lid 140 is connected to the jokduri frame 100*a*.

Figure 9:
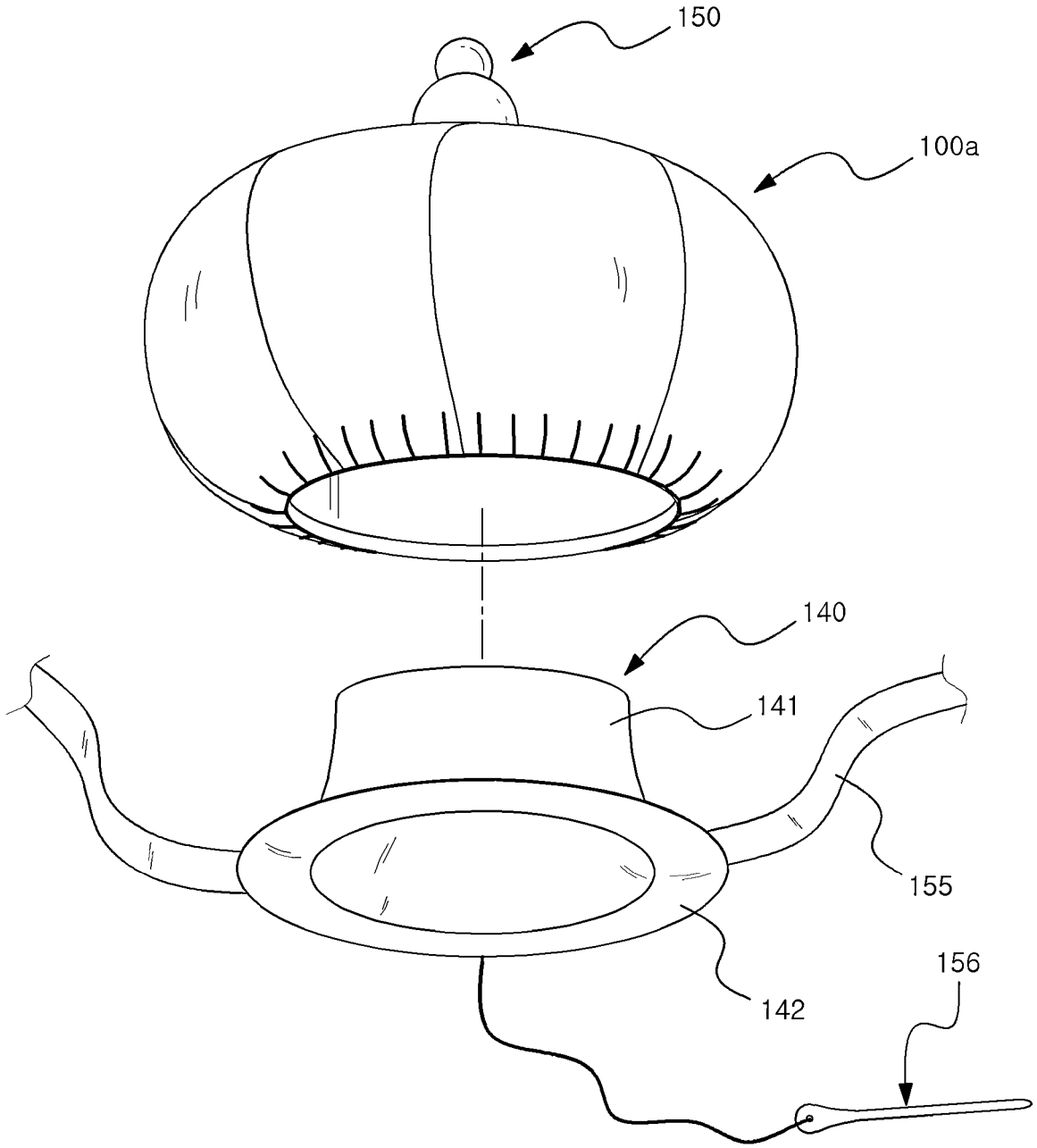
FIG. 9 is an exploded perspective view illustrating the jokduri frame and a lower lid according to the present invention.
Figure 10:
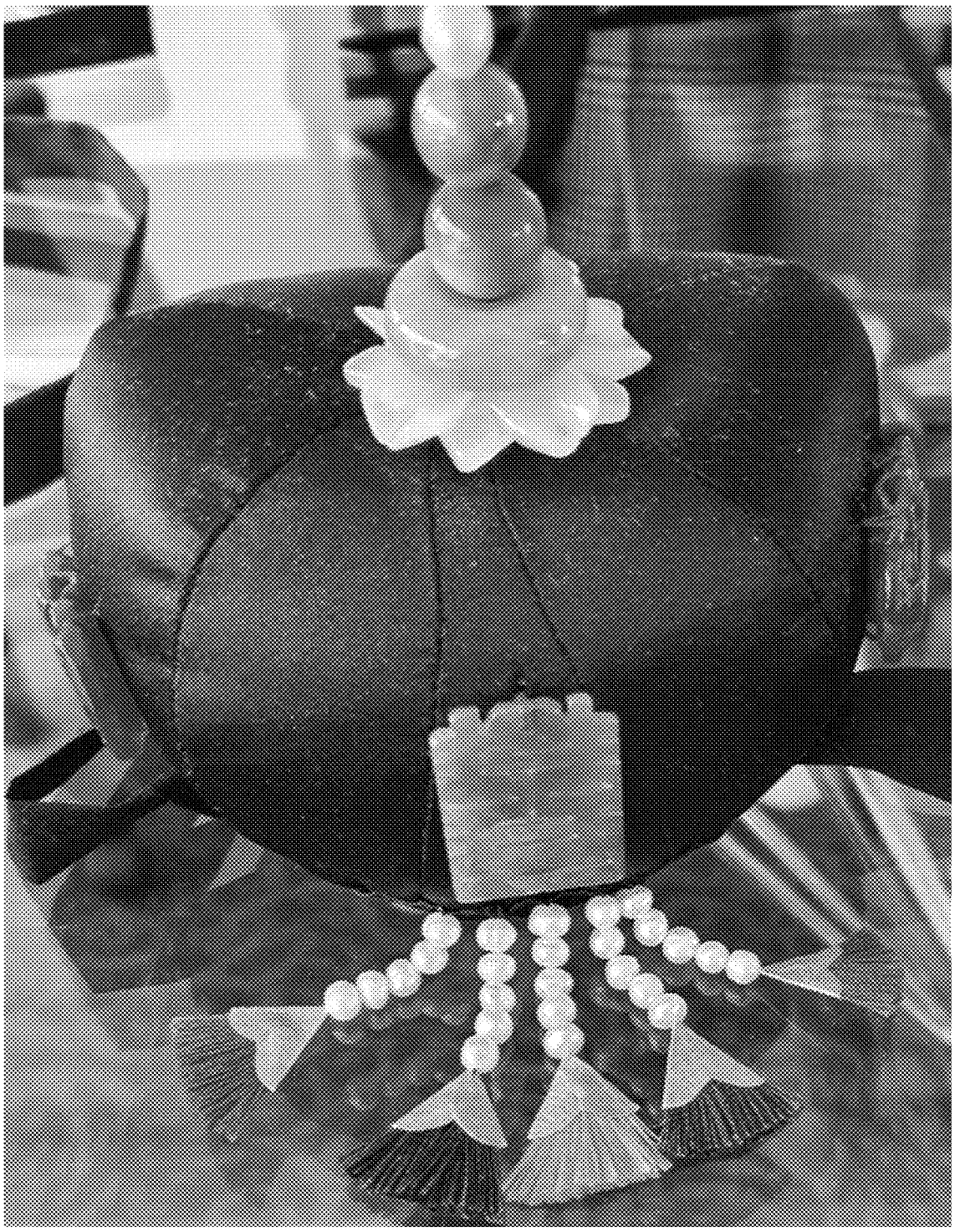
FIG. 10 is a photograph of a test sample of the jokduri according to the present invention.

The edge part 142 of the lower lid 140 is sewn onto the outer frame 110, and in this case, as shown in FIGS. 9 and 10, when the edge part 142 of the lower lid 140 is sewn onto the outer frame 110 in the state in which an ornament configured such that five-color tassels 154 (pink, green, yellow, blue and red tassels being sequentially disposed from the left) are connected to pearl beads 153 are disposed so as to be located at the front portion of the jokduri frame 100*a*, a pair of straps 155 configured to fix the jokduri to a woman's head is disposed so as to be located at the left and right sides of the jokduri frame 100*a*, and a hair peg 156 is disposed so as to be located at the rear portion of the jokduri frame 100*a*, manufacture of the jokduri is completed.

As is apparent from the above description, in a method for manufacturing a jokduri according to the present invention, a primary cotton member is inserted into an outer frame formed of fabric, an inner frame is mounted in the outer frame, and then a secondary cotton member is inserted into the space between the inner frame and the outer frame so that not only the upper region of the inside of the outer frame but also the left and right sides of the inside of the outer frame are uniformly filled with cotton and thus the overall shape of the jokduri may be easily fixed, thereby shortening the time taken to fix the shape of the jokduri and enabling the jokduri to be easily manufactured regardless of a worker's proficiency, unlike the conventional method.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a jokduri, the method comprising:

preparing an outer frame having a cylindrical shape having an open lower part by connecting a plurality of outer frame pieces by sewing;

filling an upper region of an inside of the outer frame with a primary cotton member;

preparing an inner frame having a cylindrical shape having an open lower part;

inserting the inner frame into the outer frame so as to be disposed directly under the primary cotton member and then fixing the inner frame to the outer frame;

filling a side space formed between the outer frame and the inner frame with a secondary cotton member; and preparing a jokduri frame by finishing the outer frame by sewing a lower end of the outer frame in a state in which the lower end of the outer frame is pulled inwards.

2. The method according to claim 1, wherein:

the inner frame is formed of paper, and comprises an upper inner frame having a circular shape, and a side inner frame having a cylindrical shape configured to be vertically open and coupled to the upper inner frame;

a plurality of first through holes is formed through an edge of the upper inner frame so as to be disposed in a circumferential direction thereof;

a plurality of second through holes is formed through an upper portion of the side inner frame so as to be disposed in a circumferential direction thereof; and the upper inner frame and the side inner frame are connected by inserting a thread into the first through holes and the second through holes.

3. The method according to claim 1, wherein:

the inner frame is formed of a synthetic resin, and comprises an upper inner frame having a circular shape, and a side inner frame having a cylindrical shape configured to extend integrally from the upper inner frame.

4. The method according to claim 1, further comprising preparing a lower lid comprising an insert part configured to surround an inner surface of the inner frame and an edge part configured to extend in a radial direction of the insert part, and connecting the lower lid to the jokduri frame, wherein the lower lid is prepared by preparing the insert part and the edge part by cutting a lining fabric and then connecting the insert part and the edge part; and the edge part of the lower lid and the jokduri frame are finished by sewing.

* * * * *